United States Patent [19]

Ibel

[11] 4,233,696

[45] Nov. 18, 1980

[54] TOILET SEAT

[76] Inventor: Manfred Ibel, 178 Fifth Ave., New York, N.Y. 10010

[21] Appl. No.: 92,768

[22] Filed: Nov. 9, 1979

Related U.S. Application Data

[62] Division of Ser. No. 922,492, Jul. 6, 1978.

[51] Int. Cl.[3] ..... A47K 13/00

[52] U.S. Cl. ..... 4/237; 4/234

[58] Field of Search ..... 4/240, 238, 237, 234, 4/112, 235, 239, 236, 6, 7

[56] References Cited

U.S. PATENT DOCUMENTS

| | | | |
|---|---|---|---|
| 1,505,048 | 8/1924 | McLeod | 4/6 UX |
| 2,036,984 | 4/1936 | Salvoni | 4/6 |
| 2,075,830 | 4/1937 | Salvoni | 4/6 |
| 3,034,137 | 5/1962 | Glou | 4/6 |
| 3,246,344 | 4/1966 | Saulson | 4/112 |
| 3,786,522 | 1/1974 | Kira et al. | 4/237 |
| 3,947,898 | 4/1976 | Ducharme | 4/6 |
| 4,048,679 | 9/1977 | Garnet | 4/237 |

*Primary Examiner*—Henry K. Artis

[57] ABSTRACT

A semi-squat toilet seat: The toilet seat has enlarged inward sloping opposite middle portions for the supportive engagement of the user's thighs and an opening including enlarged front and rear portions and a relatively narrow middle portion. The lack of any support areas in the front and rear portions of the toilet seat in combination with the inwardly sloped configuration of the enlarged opposite middle portions positions the user into a semi-squat position, thighs and buttocks spread apart, legs angled upwardly, body bent forward at the waist, over the middle portion of a toilet bowl. The enlarged front and rear portions of the opening allow the insertion of the hand for blotting and wiping and prevent soiling.

4 Claims, 9 Drawing Figures

TOILET SEAT

This is a division of pending application Ser. No. 922,492 which was filed on July 6, 1978 (Priority Date).

BACKGROUND OF THE INVENTION

1. Field of the Invention

The present invention relates to toilet seats, and more particularly to a toilet seat which positions the user into a semi-squat position over the middle of the usual toilet bowl to facilitate easy and hygienic defecation.

2. Discussion of Prior Art

In a co-pending patent application, called COMBINATION TOILET SEAT AND BIDET BASIN, Ser. No. 922,492; filed on July 6, 1978, I have discussed and described my novel toilet seat in detail. This particular application is required for divisional reasons as related to claims for the toilet seat only.

In recent years our western society has become more health-oriented. However, today's toilet seats do not reflect this growing trend. Most conventional toilet seats are not contoured to fit the anatomy of the user's body. These seats make defecation difficult instead of easy. As to size, even the elongated conventional seat barely gives adequate clearance lengthwise for the perineum and genitals of the average user. The conventional seat positions the thighs of the user relatively parallel to each other and parallel to the horizontal plane of the seat thus making defecation most difficult. A critical investigation and analytical discussion of the conventional toilet seat and requirements related to elimination and personal hygiene can be found in Alexander Kira's book, *The Bathroom.*

Prior art toilet seat constructions have offered new shapes for replacement of the conventional toilet seat. One group, including U.S. Pat. Nos. 807,305; 1,163,149; Des. 222,965; Des. 226,912; 3,786,522; features a rear portion of the seat being sloped upwardly and rising above the normal surface of the seat to prevent the user to sit or lean backwards, urging him to bend forward at the waist. In addition, U.S. Pat. No. 3,786,522 encourages the user to spread the legs by making it uncomfortable to rest the thighs on a ridge detail on the inner sides of opposite front portions of the seat. U.S. Pat. No. 2,099,118 puts the user into a "squatting position" by featuring a seat structure of a curved or bowed construction. U.S. Pat. Nos. Des. 222,466 has enlarged inwardly sloped opposite middle and front portions for supportive engagement of the user's thighs in the front portion of the seat with an enlarged rear portion and a narrow oblong front portion of its opening. This construction does not spread the legs and does not provide an enlarged front portion of its opening to allow for the insertion of the hand for blotting.

Accordingly, it is an object of the present invention to provide a more anatomically functional toilet seat which positions the user in the semi-squat position over the middle portion of a toilet bowl for easy defecation.

Another object of my invention is to provide a toilet seat which offers a large seating surface for the thighs for greater seating comfort.

Another object of my invention is to provide a toilet seat which spreads thighs and buttocks of the user.

Yet another object of my invention is to provide a toilet seat which has enlarged front and rear portions of its opening to allow for the insertion of the hand for wiping and blotting while remaining seated and to prevent soiling of the seat.

Yet another object of my invention is to provide a toilet seat which can be safely used by small children and frail old people: The narrow middle portion of the seat opening prevents the user to slide into the toilet bowl.

SUMMARY OF THE INVENTION

In accordance with an aspect of the present invention my novel toilet seat has enlarged inwardly sloped opposite middle portions for the supportive engagement of the user's thighs, spreading the thighs and buttocks and angling the legs upwardly, knees at a relatively higher elevation than the hipbones of the user. An enlarged rear portion of the toilet seat opening and lack of support surfaces in the rear portion of the seat induce the user to bend forward at the waist for proper balance, thus the user being positioned in a semi-squat position over the middle portion of a toilet bowl for easy and hygienic defecation. An enlarged front position of the seat opening allows for the insertion of the hand while being seated for blotting and prevents soiling. The enlarged rear portion of the seat opening allows for the insertion of the hand while remaining seated for wiping and prevents soiling.

BRIEF DESCRIPTION OF THE DRAWINGS

The above and other objects, features and advantages of my invention will be apparent in the following detailed description of an illustrative embodiment thereof, which is to be read in connection with the accompanying drawings, wherein.

DETAILED DESCRIPTION OF THE INVENTION

It is a known fact that the full-squat position is an ideal posture for easy defecation because it naturally encourages the expulsion process. It is also a known fact that our present-day toilets and toilet seats are not constructed according to the physiological requirements of the defecation process. No question, a semi-squat toilet seat positioned over a conventional toilet bowl constitutes a comprise. But such a compromise is presently most feasible and practical because it does not cost much to replace an obsolete old toilet seat with a new semi-squat toilet seat as described herein.

Figure 1:
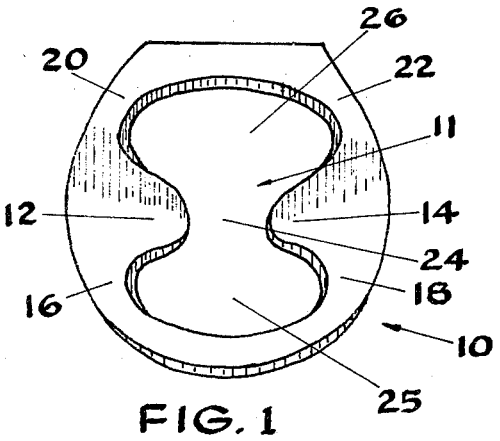
FIG. 1 is a front perspective view of a toilet seat constructed in accordance with the present invention.
Figure 2:
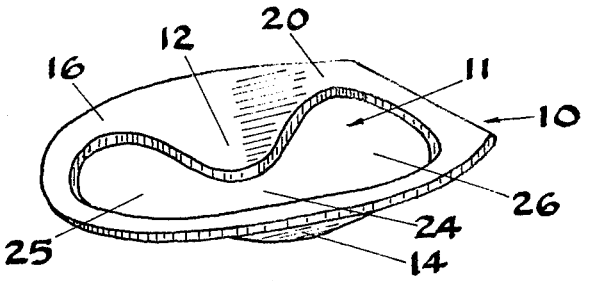
FIG. 2 is a side perspective view corresponding to FIG. 1.
Figure 3:
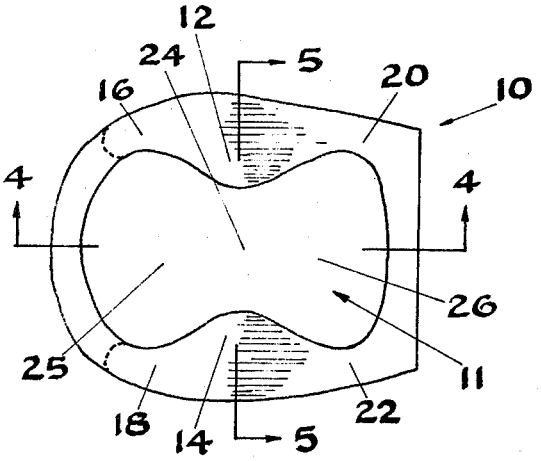
FIG. 3 is a plan view of FIG. 1 with dotted lines showing an open-front type version of the same seat.
Figure 4:
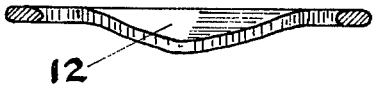
FIG. 4 is a cross-sectional view of FIG. 3 taken along lines 4—4.
Figure 4A:
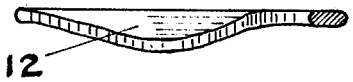
FIG. 4A is a cross-sectional view of FIG. 3 taken along lines 4—4 showing the dotted-line configuration of the open-front version.
Figure 7:
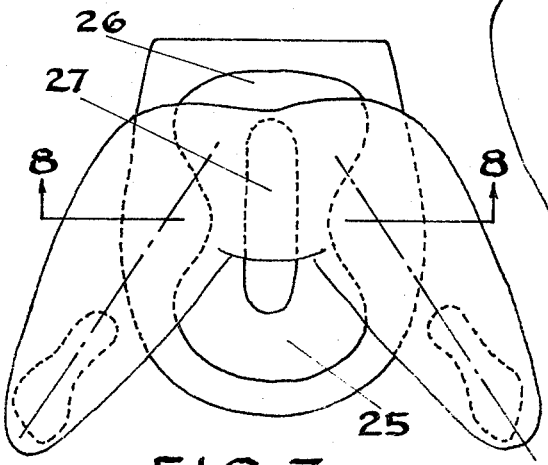
FIG. 7 is a diagrammatic plan view of FIG. 1 illustrating a person seated on the toilet seat.
Figure 8:
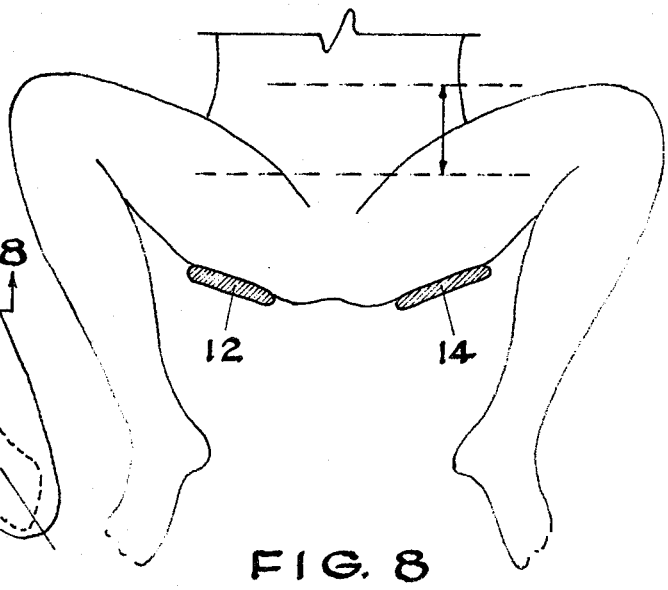
FIG. 8 is a combined cross-sectional and front elevational view of FIG. 7 taken along lines 8—8.

As seen in FIGS. 1–6, toilet seat 10 is shown with toilet seat opening 11 having an approximate figure-8-shape configuration, defined by enlarged inwardly extended and inwardly sloped opposite middle portions 12,14 provided for the support of the user's thighs, and defined by relatively narrow opposite front surface areas 16,18 and by relatively narrow opposite rear surface 20,22. FIG. 3 shows also an open-front version (dotted lines) of the same seat wherein the underlying toilet bowl rim completes the image of the approximate figure-8-shape configuration of opening 11. The inwardly-sloped enlarged middle portions 12,14 define a relatively narrow middle portion 24 of opening 11 and follow the angle of the seated user's thighs in the semi-squat position placing the knees above the hip joints, as illustrated in FIG. 8. An enlarged front portion 25 and enlarged rear portion 26 of opening 11 provide extra space adjacent the front and rear of the perineal area 27 of the user to prevent soiling of the seat and to allow for the insertion of the hand for wiping and blotting while being seated, as shown in FIG. 7. Enlarged rear portion 26 also prevents the user to sit on the back portion of the seat. The lack of any support surfaces in the rear induces the user to bend forward at the waist for proper balance. The front portion of the seat does not offer any support surfaces for the thighs; the user is thus induced to sit on the comfortable inwardly-sloped middle portions 12,14, with legs spread apart and angled upwardly, naturally assuming a semi-squat position over the middle portion of a toilet bowl for easy defecation and optimal hygiene, as illustrated in FIGS. 7,8.

Figure 5:
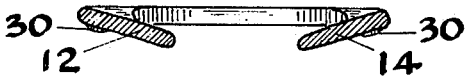
FIG. 5 is a cross-sectional view of FIG. 3 taken along lines 5—5.
Figure 6:
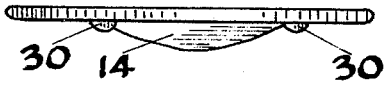
FIG. 6 is a side elevational view corresponding to FIG. 1.

As shown in FIGS. 5,6 buttons 30 support toilet seat 10 on the top surface of a toilet bowl and lie parallel to the plane of the support surface. It should be noted that the outer peripheral edge of seat 10 may have a different configuration as required to fit different styles and types of existing toilets. Any desired hinge means can be employed for attaching seat 10 to a toilet bowl. Any commonly employed materials such as wood, wood compositions, plastics or any other suitable materials can be used for the construction of the seat.

Although an illustrative embodiment of my invention has been described herein with reference to the accompanying drawings, it is to be understood that the invention is not limited to that precise embodiment and that various changes and modifications may be effected therein by one skilled in the art without departing from the scope or spirit of this invention.

What is claimed is:

1. A toilet seat for positioning on a toilet bowl, said seat having an opening and an upper surface including enlarged inwardly extended opposite middle portions for the supportive engagement of the user's thighs, said enlarged middle portions being inwardly sloped and having opposite inner peripheral edge portions defining a relatively narrow middle portion of said opening, said opposite inner peripheral edge portions being on a substantially lower elevation than the outer peripheral upper surface areas of the seat and positioning the perineum of the user on said substantially lower elevation, said enlarged inwardly sloped middle portions also positioning the user's legs upwardly angled with the knees positioned above the elevation of the hip joints; said toilet seat having relatively narrow opposite front surface areas; said toilet seat having relatively narrow opposite rear surface areas defining an enlarged rear portion of said opening; the combined effect of said features positioning the user into a semi-squat position over the middle portion of a toilet bowl for easy defecation.

2. A toilet seat as defined in claim 1 wherein said seat is having an arcuate front portion with a relatively narrow front surface area, said arcuate front portion and said relatively narrow opposite front surface areas defining an enlarged front portion of said opening.

3. A toilet seat as defined in claim 1 wherein said opposite enlarged middle portions defining said relatively narrow middle portion of said opening are having inner peripheral edges being convexly curved; said relatively narrow opposite rear surface areas having inner peripheral edges being concavely curved.

4. A toilet seat as defined in claim 3 wherein said seat is having an arcuate front portion with a relatively narrow front surface area having an inner peripheral edge being concavely curved; said relatively narrow opposite front surface areas having inner peripheral edges being concavely curved; the combined image of said concavely and convexly curved inner edges of said seat defining a toilet seat opening having an approximate figure-8-shape configuration.

* * * * *